US006084359A

United States Patent [19]

Hetzel et al.

[11] Patent Number: 6,084,359

[45] Date of Patent: Jul. 4, 2000

[54] COIL ASSEMBLY FOR AN ELECTRODELESS FLUORESCENT LAMP

[75] Inventors: Frederick Hetzel, North Royalton; Robert S. McFeely, Valley View; Vito Joseph Arsena, Highland Heights; Joseph C. Oberle, Chagrin Falls, all of Ohio; David O. Wharmby, Ilkley, United Kingdom; Steven John Everest, London, United Kingdom; Mahomed Hanif Girach, Leicester, United Kingdom

[73] Assignee: General Electric Company, Schenectady, N.Y.

[21] Appl. No.: 08/882,131

[22] Filed: Jun. 25, 1997

[30] Foreign Application Priority Data

Jun. 26, 1996 [GB] United Kingdom ..... 9613359

[51] Int. Cl.[7] ..... H01J 65/04; H05B 41/00

[52] U.S. Cl. ..... 315/248; 315/56; 315/58; 362/365; 313/493

[58] Field of Search ..... 313/490, 491, 313/493, 483, 489; 315/248, 246, 291, 58, 57, 56; 362/260, 265, 364, 365, 226, 267

[56] References Cited

U.S. PATENT DOCUMENTS

| | | | |
|---|---|---|---|
| 3,521,120 | 7/1970 | Anderson | 315/57 |
| 3,905,000 | 9/1975 | Walter . | |
| 4,158,153 | 6/1979 | Eckberg | 313/491 |
| 4,176,296 | 11/1979 | Anderson . | |
| 4,298,828 | 11/1981 | Justice et al. | 315/248 |
| 4,800,357 | 1/1989 | Nickels, Jr. et al. | 336/198 |
| 4,940,923 | 7/1990 | Kroontje et al. | 315/248 |
| 5,128,590 | 7/1992 | Holzer | 315/57 |
| 5,184,890 | 2/1993 | Chen et al. | 362/226 |
| 5,237,240 | 8/1993 | Bouchard | 313/550 |
| 5,461,284 | 10/1995 | Roberts et al. | 313/491 |

FOREIGN PATENT DOCUMENTS

| | | |
|---|---|---|
| 0 660 375 A2 | of 0000 | European Pat. Off. . |
| 0 615 260 A1 | 10/1994 | European Pat. Off. . |
| 39 15 044 A1 | 5/1989 | Germany . |
| 2 146 847 | 4/1985 | United Kingdom . |
| WO 83/03495 | 10/1983 | WIPO . |
| WO 84/01854 | 5/1984 | WIPO . |
| WO 91/15021 | 10/1991 | WIPO . |
| WO 83/03495 | 10/1993 | WIPO . |
| WO 95/27995 | 10/1995 | WIPO . |

*Primary Examiner*—David Vu
*Assistant Examiner*—Wilson Lee
*Attorney, Agent, or Firm*—Fay, Sharpe, Fagan, Minnich & McKee, LLP

[57] ABSTRACT

A coil assembly for an electrodeless fluorescent lamp comprises a hollow ferrite core 30, and a coil 31. The core is retained on a base 32 by a coil former 34 surrounding the core. The core 30 is retained in the former 34 by a circlip 33 or projections. The coil 31 is wound on the former. Pins 36 to which the coil is soldered connect the coil to an energizing circuit.

17 Claims, 5 Drawing Sheets

COIL ASSEMBLY FOR AN ELECTRODELESS FLUORESCENT LAMP

FIELD OF THE INVENTION

BACKGROUND OF THE INVENTION

One aspect of the present invention relates to a coil assembly. An illustrative use of the coil support is in an electrodeless fluorescent lamp and the coil support will be described hereinafter with reference to that use. Another aspect of the invention relates to an electrodeless fluorescent lamp having the coil assembly.

DISCUSSION OF THE ART

An electrodeless fluorescent lamp is known for example from EP-A-0 660 375.

The lamp comprises a sealed discharge vessel containing a fill which when energized sustains a discharge. The vessel is coated with, amongst other things, a layer of phosphor which converts the UV radiation of the discharge to visible light. The vessel has re-entrant portion containing a coil of a coil assembly which produces a radio frequency (RF) solenoidal field in the vessel. The coil is energized by an RF oscillator. The RF oscillator is housed in a housing which supports the coil assembly, the oscillator, and the discharge vessel. The coil assembly comprises a base member which is supported by the housing. The coil of the assembly comprises a core and a winding on the core. The core is a hollow circular cylinder of ferrite. The winding is wound directly on the core. The core and winding is fixed to the base member using a suitable adhesive. The winding is connected to connecting pins on the base member. The connecting pins provide connection to the oscillator.

BRIEF SUMMARY OF THE INVENTION

According to one aspect of the present invention, there is provided a coil assembly comprising a base, a core of magnetically permeable material supported on the base, a coil around the core, and means for retaining the core on the base, the retaining means including a clip engaging the core.

Thus the use of adhesives is avoided and the procedure for making the assembly is simplified by clipping the core to the base.

In one embodiment of the invention, the core is hollow, and the clip of the retaining means comprises at least a pair of fingers extending through the centre of the core, each finger having a lateral projection which engages the end of the core remote from the base.

Thus, the core is pushed onto the fingers which act as the clip to retain it, simplifying the assembly operation.

In another embodiment of the invention, the retaining means comprises at least a pair of fingers between which the core is located, each finger having a lateral projection engaging the end of the core remote from the base.

Thus, the core is pushed between the fingers which act as the clip to retain it simplifying the assembly operation.

In a yet further embodiment, the retaining means is a coil former around the core, and the core is held in the coil former by the said clip which may be a circlip within the coil former, or a plurality of fingers having lateral projections engaging the core.

Another aspect of the present invention provides an electrodeless fluorescent lamp comprising: a discharge vessel containing a fill which when energized sustains a discharge and at least a phosphor coating on the inner surface of the vessel, the vessel having a re-entrant portion; and a coil assembly in accordance with said one aspect of the invention, the coil of which is in the re-entrant portion.

An embodiment of the said another aspect further comprises a housing supporting the base of the coil assembly, and the discharge vessel.

The housing may house means for energising the coil with an RF signal.

A further aspect of the invention provides an electrodeless fluorescent lamp comprising a coil assembly having a base;

a discharge vessel having a re-entrant portion housing the coil assembly;

a split ring having a channel extending around the base of the vessel, the ring being fixed to the base of the coil assembly; and a housing;

the ring being compressed by the housing to clamp the base of the vessel in the channel.

In an embodiment of the further aspect, the split ring is supported by the base of the coil assembly, the base being split, the base and thus the ring also being compressed by the housing.

In another embodiment of the further aspect, the base is supported in the split ring, the ring being compressed by the housing to clamp the base and the vessel in the ring.

BRIEF DESCRIPTION OF THE DRAWINGS

For a better understanding of the present invention, reference will now be made, by way of example, to the accompanying drawings, in which.

DETAILED DESCRIPTION OF THE INVENTION

Figure 1:
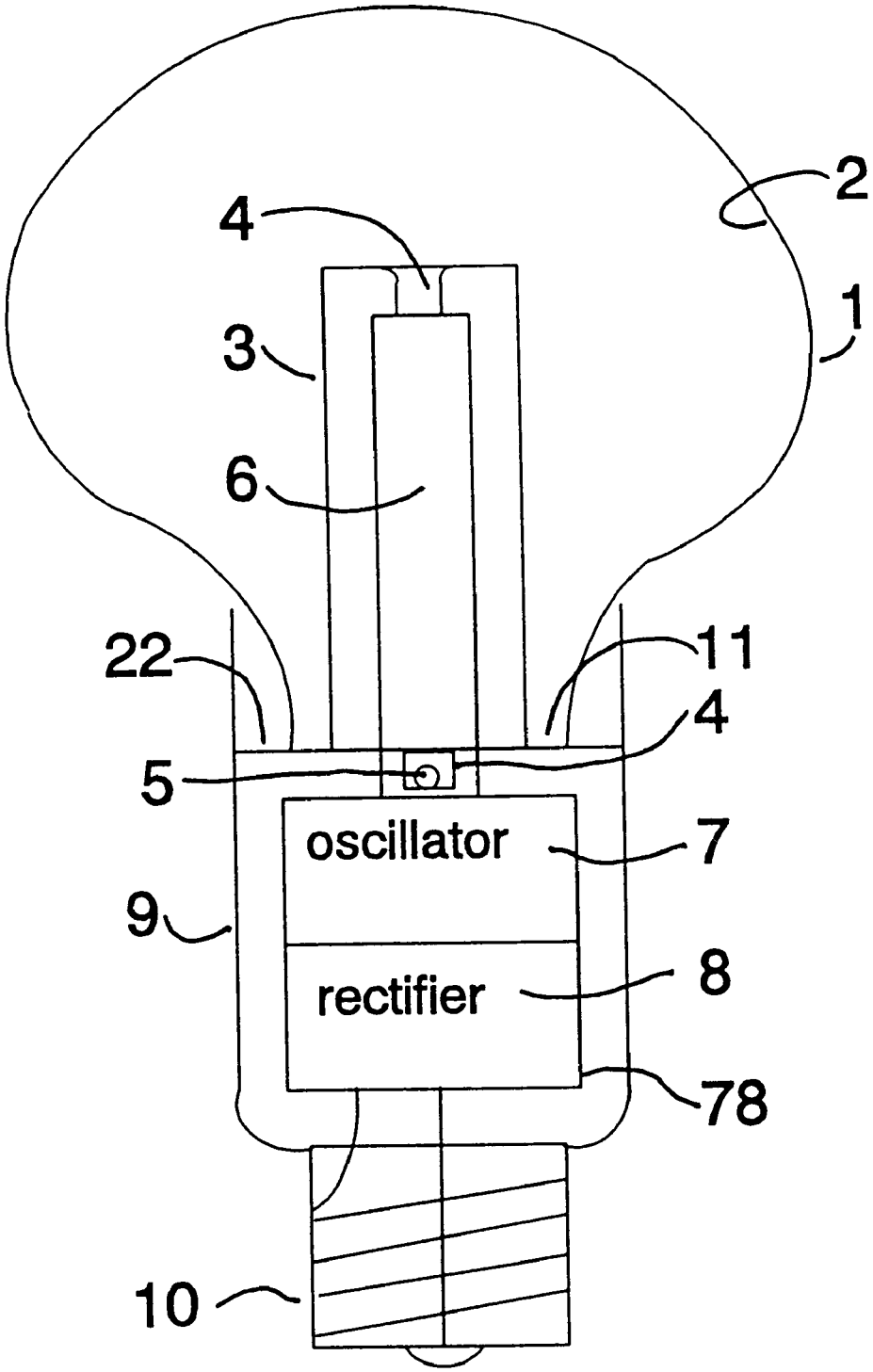
FIG. 1 is a simplified schematic diagram of an electrodeless fluorescent lamp.

Referring to FIG. 1, the fluorescent lamp comprises a sealed discharge vessel 1 containing a known fill (not shown) including mercury vapour capable of sustaining a discharge when suitably energized. The discharge produces UV light which is converted to visible light by a phosphor coating 2 on the inner surface of the vessel. The vessel may have other coatings as known in the art. The other coatings include an electrically conductive, transparent layer (not shown).

The vessel has a re-entrant portion 3 and an exhaust tube 4 extending along the axis of the re-entrant portion. The exhaust tube contains mercury amalgam 5.

The discharge is energized by an RF field produced by a coil 6 in the re-entrant portion 3. The coil 6 is energized by a circuit 78 comprising an RF oscillator 7 and a rectifier 8.

The coil 6 is part of a coil assembly which will be described hereinbelow. The coil assembly, discharge vessel and energising circuit 78 are supported by a housing 9 to which a lamp cap 10 such as a bayonet cap or screwcap is connected.

Figure 2:
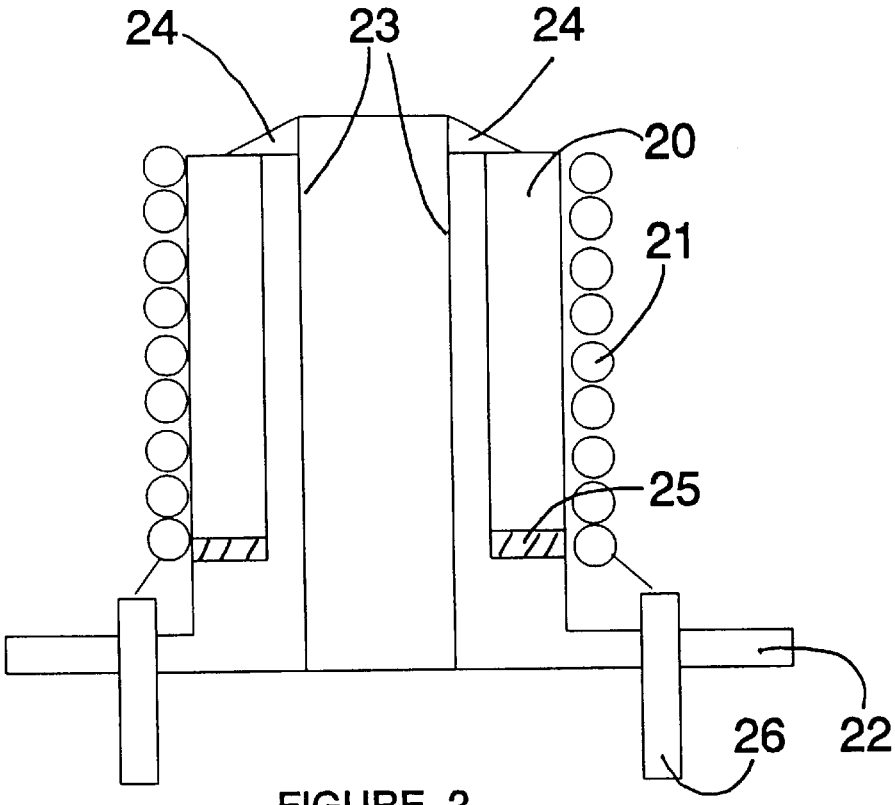
FIG. 2 is a sectional view of an illustrative coil assembly in accordance with one aspect of the invention.

FIG. 2 shows an illustrative coil assembly. The assembly comprises a hollow circular cylindrical ferrite core 20 around which a coil 21 is wound. The coil 21 may be wound directly on the core 20.

The assembly comprises a base 22 which in this example supports the discharge vessel 1. Referring to FIG. 1, the lower lip 11 of the vessel 1 rests on the base 22. The vessel 1 may be fixed to the base in any suitable manner.

The core 20 is a hollow circular cylinder through which the exhaust tube 4 extends. Integral with the base 22 and upstanding therefrom is at least a pair of fingers 23 which extend through the centre of the core. The fingers have, at their ends, remote from the base, lateral projections 24 which engage the core and retain it on the base.

The fingers are resilient. To assemble the core to the support, the core is pushed over the fingers until the projections engage its surface remote from the base. Thus, the fingers act as a clip.

A spring washer 25 may be provided between the core and the base 22, to prevent the core rattling on the support.

The coil 21 is soldered or connected by other means such as crimping to pins 26 which connect the coil to the energising circuit 78.

In an alternative arrangement the projections 24 are replaced by a circlip (not shown). In that arrangement, the fingers may be replaced by a tube.

Figure 3:
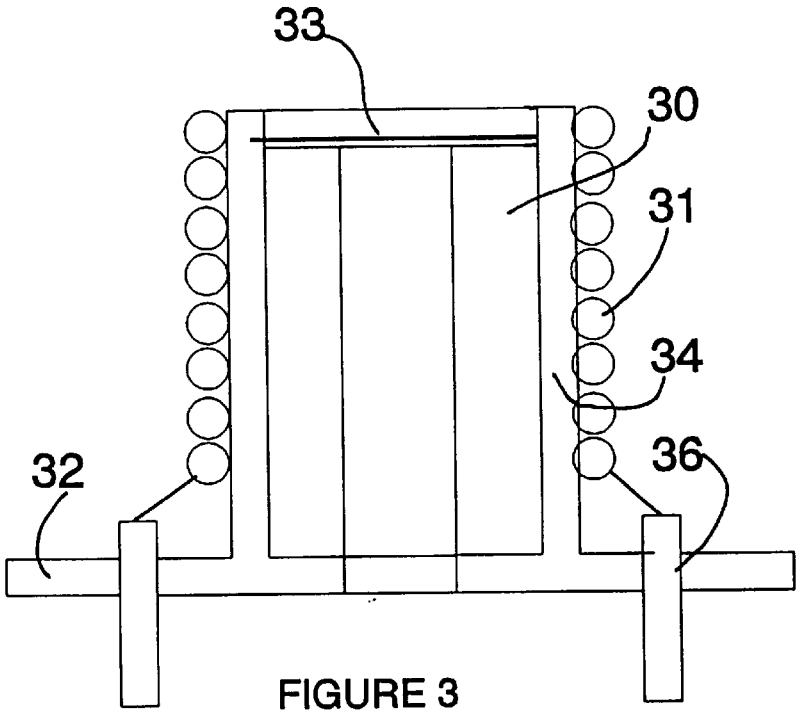
FIG. 3 is a sectional view of another illustrative coil assembly in accordance with one aspect of the invention.

Referring to FIG. 3, another coil assembly comprises a hollow circular cylindrical ferrite core 30 and a coil 31. The exhaust tube 4 of the discharge vessel extends through the centre of the core 30.

The assembly comprises a base 32 which may support the discharge vessel in the same way as base 22 of the support of FIG. 2.

Integral with the base 32 and upstanding from it is a coil former 34. The coil 31 is wound on the former 34. The core is retained within the coil former by a circlip 33 which is held in a groove in the inner circumference of the coil former. The circlip 33 could be replaced by inwardly directed projections similar to projections 24 of FIG. 2.

The coil 31 is soldered or connected by other means such as crimping to pins 26 which connect the coil to the energising circuit 78. A spring washer similar to washer 25 of FIG. 2 may be provided to prevent the core rattling.

Figure 4:
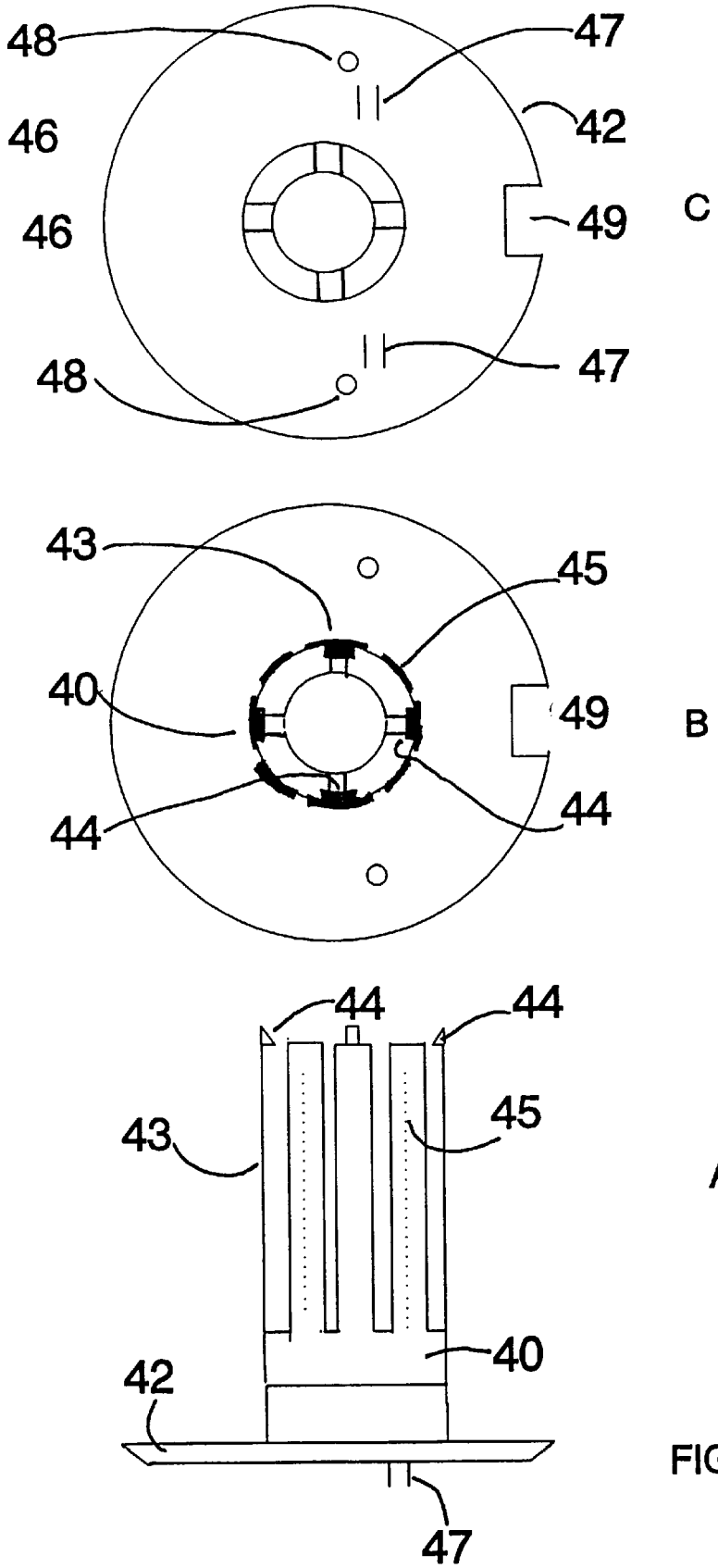
FIGS. 4A–C are side, top and bottom views of a coil support of a currently preferred embodiment of the invention, FIGS. 5A and B are partial views of the housing of the lamp.

FIGS. 4A to 4C show a coil support of the currently preferred embodiment of the invention.

The coil support is a single-piece plastic moulding comprising a circular base 42 integral with a cylindrical coil former and core retainer 40 upstanding from the base. The cylindrical former and retainer 40, in use, houses a hollow circular cylindrical ferrite core (not shown for clarity). The former and retainer 40 is defined by core retaining fingers 43 interleaved with coil forming fingers 45. The core is axially retained within the retainer 40 by flanges 46 in the end of the retainer 40 near the base 42 and by lateral projections 44 at the ends of the core retaining fingers 43 remote from the base 42. The projections 44 engage the end of the core remote from the flanges 46. The coil forming fingers 45 have winding guides moulded thereon. The fingers 43 and 45 are resilient.

To make the coil assembly, the ferrite core is pushed into former and retainer 40 and retained axially between the flanges 46 and the projections 44.

A coil is then wound on the coil forming fingers. The fingers 43 and 45 are pressed by the winding of the coil onto the core whereby the wound coil also retains the core.

The base 42 has pairs 47 of walls defining slots for holding the edge of a circuit board of the energising circuit 78. The board is offset from the centre of the base 42 to avoid contacting the end of the exhaust tube 4.

Apertures 48 are provided in the base 42 adjacent the slots for connecting pins to which the coil is soldered, or connected by other means such as crimping, and which connect the coil to the circuit board 78.

A slot 49 is provided in the edge of the base 42 to engage a projection in the housing 9 to prevent rotation of the coil assembly relative to the housing and to allow the coil assembly to fit with the housing in only one orientation.

FIG. 5B is a partial sectional view of the housing 9, the circuit board 78 and the base 42 of the coil assembly, and the discharge vessel 1.

The housing 9 has an internal cylindrical flange 50 which supports the base 42. The base is retained on the flange by wedges 51. The flange 50 and wedges 51 are moulded integrally with the housing 9. A projection 52 (FIG. 5A) of the flange 50 engages the anti-rotation slot 49 (FIG. 4B) in the edge of the base 42.

To fix the base 42 in the housing, the base 42 is simply pushed over the wedges 51 until it snaps into position between the flange 50 and the wedges 51.

Various modifications may be made to the embodiments described above. The discharge vessel 1 may be directly supported by the base of the coil assembly as shown in FIG. 1. Alteratively, the vessel 1 may be supported directly by the housing 9.

Figure 5:
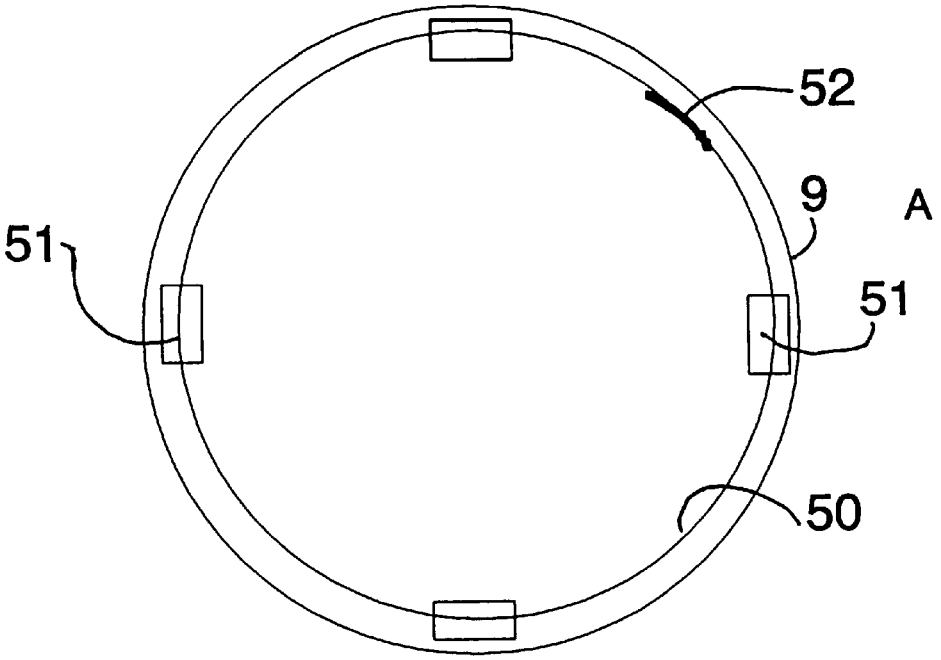
Figure 5:
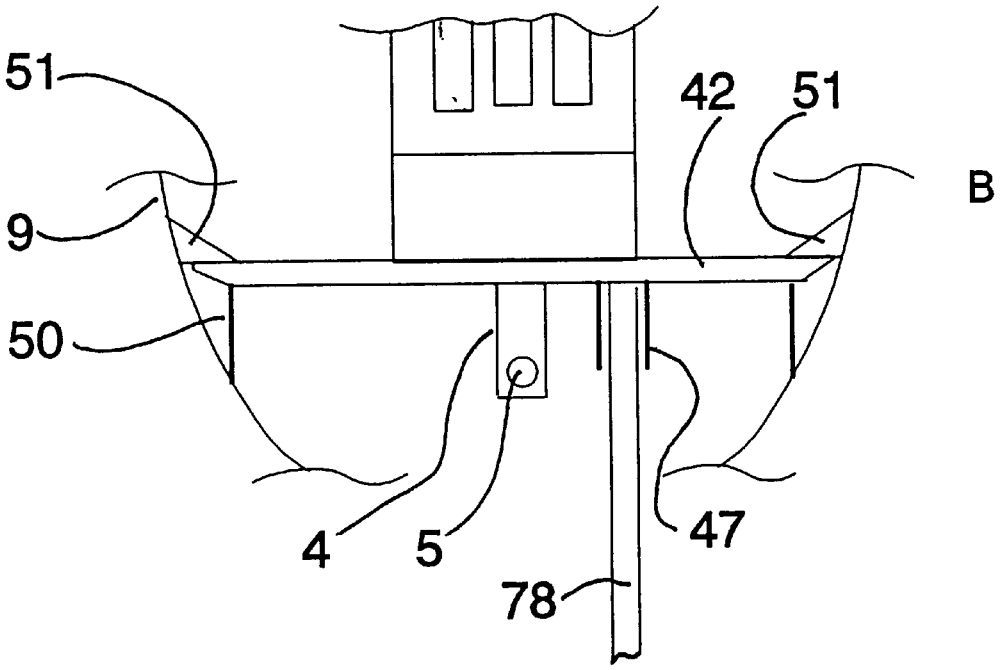

The circuit board 78 of FIG. 5 may have sockets which receive the connecting pins 26 or 36.

Figure 6:
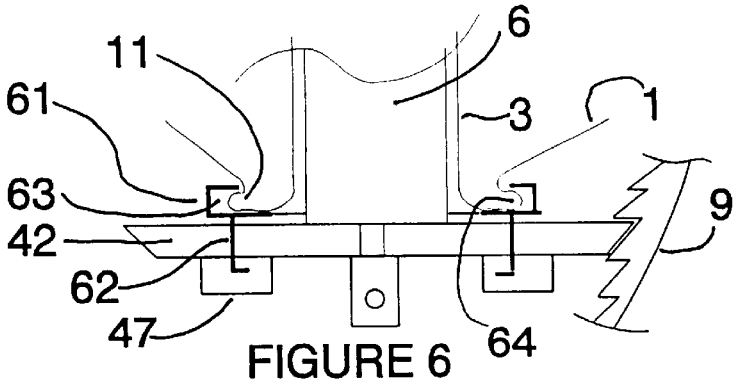
FIG. 6 is a partial sectional view of another embodiment of the coil support.
Figure 7:
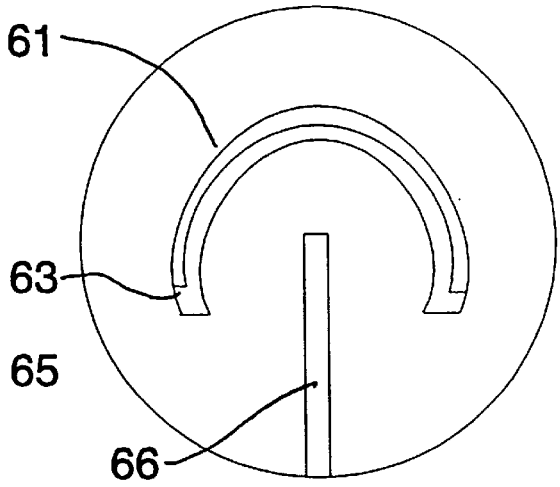
FIG. 7 is a plan view of a clip used in the embodiment of FIG. 6.

FIG. 6 illustrates two modifications of the arrangement of FIG. 5B. In FIG. 6 the flange 50 and wedges of FIG. 5B are replaced by a ratchet 60 integrally moulded with the housing 9. Furthermore the discharge vessel is retained by a split ring 61 (also shown in FIG. 7) fixed to the base 42 of the coil assembly by detents 62 which project through corresponding slots in the base 42 and clip it to the base.

The lower lip 11 of the discharge vessel is formed with a radially outward projection in the form of a bulge 64. The split ring 61 has a channel 63 which engages the bulge over an arc of approximately 180° around the vessel.

To assemble the vessel, the clip and the coil support, the split ring 61, which has an opening 65 for receiving the vessel, is pushed on to the bulge 64. The vessel and split ring are then placed over the coil support, and the detents 62 pushed into the slots in the base 42 of the coil support.

To fix the vessel to the clip, adhesive may be used. Alternatively, the base 42 is split along a radius 66. As the base is forced along the ratchet, the split, and thus the clip also, is compressed clamping the vessel in the clip.

Figure 8:
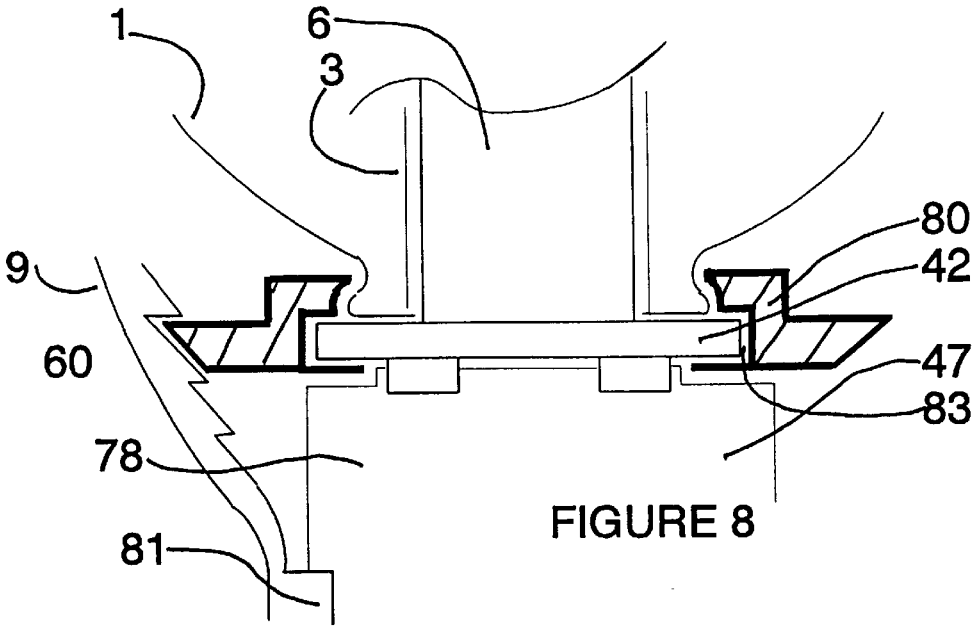
FIG. 8 is a sectional view of an alternative to the embodiment of FIGS. 6 and 7.

Referring to FIG. 8, the coil assembly 6 has a base 42 which is supported by a resilient split ring 80.

The outer circumference of the ring 80 engages the ratchet 60 on the housing. The base 42 is held in a groove in the inner circumference of the ring 80. The bulge 64 at the base of the vessel is engaged by a channel 83 above the base 42 in the ring 80. The circuit 78 is fixed to the base 42 by the slots 47. Further slots 81 are provided in the housing to prevent rotation of the board in the housing 9.

To assemble the vessel 1, ring 80, coil assembly 6 board 78 and housing 9:

the split ring is opened sufficiently to snap the base 42 of the coil assembly into the groove in the ring;

the circuit board is fixed in the slots 47 and the coil connected to the board preferably by means of sockets on the board engaging with connector pins on the base 42;

the discharge vessel is snapped into the channel 83;

the resulting assembly is pushed down into the housing engaging the ratchet 60; and the ratchet compresses the ring 80 to retain the discharge vessel and the base 42.

The lamp may be made and sold separately from the energising circuitry comprising the energising circuit 7, 8 comprising the oscillator 7 and rectifier 8. The energising circuit 7, 8 may be housed separately from the discharge vessel and coil assembly.

What is claimed is:

1. An electrodeless fluorescent lamp comprising:

a discharge vessel containing a fill which when energized sustains a discharge and at least a phosphor coating on the inner surface of the vessel, the vessel having a re-entrant portion; and, a coil assembly comprising:

a base, a core of magnetically permeable material supported on the base, a coil around the core, and a retaining clip arrangement for securing the coil relative to the base and retaining the core on the base;

the coil and core of the coil assembly being housed in the re-entrant portion of the vessel.

2. The assembly according to claim 1, wherein the retaining means is integral with the base.

3. The lamp according to claim 1, wherein the retaining clip arrangement comprises at least a pair of fingers between which the core is located, the fingers having respective lateral projections engaging the end of the core remote from the base.

4. The lamp according to claim 1, wherein the core is hollow and the retaining clip arrangement comprises at least a pair of fingers extending through the core, the finger having respective lateral projections engaging the end of the core remote from the base.

5. The lamp according to claim 1, wherein the coil is wound directly on the core.

6. The lamp according to claim 1, wherein the retaining clip arrangement is also a coil former, within which the core is located, the coil being wound on the coil former, and the core is retained in the former by a circlip within the former.

7. The lamp according to claim 1, further comprising a housing supporting the coil assembly and the discharge vessel.

8. The lamp according to claim 1 wherein the vessel is directly supported by the base of the coil assembly.

9. The lamp according to claim 1 wherein the base of the vessel has a radially outward projection engaged in a channel being defined in a clip fixed to the said base of the coil assembly.

10. The lamp according to claim 7, comprising a split ring extending around the base of the vessel and around the base of the coil assembly, the split ring being compressed by insertion into the housing to clamp the base of the coil assembly and the base of the vessel.

11. The assembly according to claim 1, wherein the retaining clip arrangement is also a coil former and comprises a first set of fingers having lateral projections engaging the end of the core and further fingers on which are winding guides.

12. The assembly according to claim 1 further comprising a circuit board retainer on the side of the base remote from the core and coil, for retaining a circuit board.

13. The assembly according to claim 1 further comprising circuit connection pins to which the coil is connected, the pins being supported by the base.

14. The lamp according to claim 1 further comprising means for energizing the coil with an RF signal.

15. The lamp according to claim 1, wherein the clip arrangement is fixed to the base by detents.

16. An electrodeless fluorescent lamp comprising:

a discharge vessel containing a fill which when energized sustains a discharge and at least a phosphor coating on the inner surface of the vessel, the vessel having a re-entrant portion; and, a coil assembly comprising:

a base, a core of magnetically permeable material supported on the base, a coil around the cores, and at least a pair of fingers between which the core is located that retain the core on the base, the fingers having respective lateral projections engaging the end of the core remote from the base;

the coil and core of the coil assembly being housed in the re-entrant portion of the vessel.

17. An electrodeless fluorescent lamp comprising:

a discharge vessel containing a fill which when energized sustains a discharge and at least a phosphor coating on the inner surface of the vessel, the vessel having a re-entrant portion; and, a coil assembly comprising:

a base, a core of magnetically permeable material supported on the base, a coil around the core, and a coil former for retaining the core on the base, the core being located in the coil former, the coil being wound on the coil former, and the core is retained in the former by a circlip within the former;

the coil and core of the coil assembly being housed in the re-entrant portion of the vessel.

* * * * *